US008385042B2

(12) United States Patent
McCann et al.

(10) Patent No.: US 8,385,042 B2
(45) Date of Patent: Feb. 26, 2013

(54) SELECTIVE CONTROL OF WIRELESS INITIATION DEVICES AT A BLAST SITE

(75) Inventors: Michael John McCann, Chadds Ford, PA (US); Ronald F. Stewart, Ottawa (CA)

(73) Assignee: Orica Explosives Technology Pty Ltd., Melbourne (AU)

( * ) Notice: Subject to any disclaimer, the term of this patent is extended or adjusted under 35 U.S.C. 154(b) by 438 days.

(21) Appl. No.: 12/656,030

(22) Filed: Jan. 13, 2010

(65) Prior Publication Data

US 2010/0212527 A1 Aug. 26, 2010

Related U.S. Application Data

(60) Provisional application No. 61/147,816, filed on Jan. 28, 2009.

(51) Int. Cl.
*F23Q 3/00* (2006.01)

(52) U.S. Cl. ..... 361/247

(58) Field of Classification Search ..... 361/247
See application file for complete search history.

(56) References Cited

U.S. PATENT DOCUMENTS 7,848,078 B2 * 12/2010 Hummel et al. ..... 361/247

FOREIGN PATENT DOCUMENTS

| | | | |
|---|---|---|---|
| CN | 2814315 | Y | 9/2006 |
| EP | 0897098 | A2 | 2/1999 |
| WO | 2005/071348 | A1 | 8/2005 |
| WO | 2006/128257 | A1 | 12/2006 |

OTHER PUBLICATIONS

PCT International Search Report in PCT/AU2010/000018, mailed Mar. 18, 2010.

PCT Written Opinion Of The International Searching Authority in PCT/AU2010/000018, mailed Mar. 18, 2010.

* cited by examiner

*Primary Examiner* — Stephen W Jackson
(74) *Attorney, Agent, or Firm* — Nixon & Vanderhye PC

(57) ABSTRACT

Disclosed herein are methods for selective control of groups of wireless initiation devices such as wireless electronic boosters at a blast site. Such methods may be applied to a wide variety of blasting techniques that would benefit from the use of wireless control and initiation of explosive charges at the blast site.

27 Claims, 6 Drawing Sheets

SELECTIVE CONTROL OF WIRELESS INITIATION DEVICES AT A BLAST SITE

CROSS-REFERENCE TO RELATED APPLICATION

Figure 1:
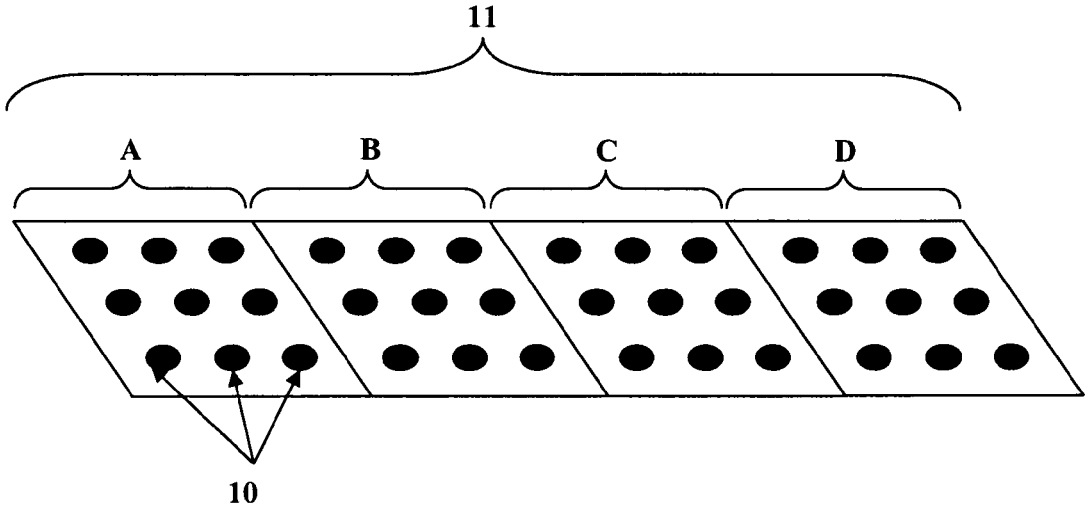

This application claims the benefit of Provisional Application No. 61/147,816, filed Jan. 28, 2009, the entire contents of which is hereby incorporated by reference in this application.

FIELD OF THE INVENTION

The invention relates to the field of blasting for mining, and the control of detonators at a blast site. More specifically, the invention relates to the control of detonators and detonator assemblies via wireless communication.

BACKGROUND TO THE INVENTION

The efficient fragmentation and breaking of rock by means of explosive charges demands considerable skill and expertise. In most mining operations explosive charges, including boosters, are placed at predetermined positions near or within the rock, for example within boreholes drilled into the rock. The explosive charges are then actuated via detonators having predetermined time delays, thereby providing a desired pattern of blasting and rock fragmentation. Traditionally, signals are transmitted to the detonators from an associated blasting machine via non-electric systems employing low energy detonating cord (LEDC) or shock tube. Alternatively, electrical wires may be used to transmit more sophisticated signals to and optionally from electronic detonators. For example, such signaling may include ARM, DISARM, and delay time instructions for remote programming of the detonator firing sequence. Moreover, as a security feature, detonators may store firing codes and respond to ARM and FIRE signals only upon receipt of matching firing codes from the blasting machine. Electronic detonators are often programmed with time delays with an accuracy of the order of about 1 ms.

The blasting systems discussed above employ physical connections between the detonators to be fired and a control unit such as a blasting machine. Typically, detonators are placed at the blast site in association with explosive charges, and connected to surface harness wires (e.g. wires, shock tubes, detonating cords or the like). Detonators present at the blast site may be selectively actuated in groups. In this way, a blast may be conducted in two or more stages. Care must be taken to ensure that later-stage detonators, their associated charges, and their connections to harness wires are not disrupted or suffer damage from explosive forces derived from earlier-stage firing. Nonetheless, it is possible to selectively actuate one group of detonators before other groups of detonators are actuated at a blast site. In such blasting systems selective, staged actuation of groups of detonators may be achieved via fairly simple means. For example, those detonators that are required to actuate for a particular stage of a blast may be connected to the harness wire(s) whereas those not required may remain unconnected or be disconnected from the harness wires. Alternatively, where multiple harness wires are present, each group of detonators may be connected to a different harness wire, with a command signal to FIRE each group transmitted via a different harness wire as desired.

Recent years have seen the development of wireless blasting systems for use in blasting rock. Such systems present significant advantages over more traditional wired blasting systems. By avoiding the use of physical connections between detonators, and other components at the blast site (e.g. blasting machines) the possibility of improper set-up of the blasting arrangement, such as improper 'tieing-in' of detonators, is reduced. Wireless blasting systems offer excellent potential for automated establishment at the blast site. For example, robotic systems may be more readily deployed for placement of wireless detonator assemblies and associated explosive charges at a blast site, since the complications of trailing wires (and the need to connect explosive devices to such wires at the blast site) are completely avoided. Wireless blasting systems, and corresponding methods employing such systems, are disclosed for example in international patent publication WO06/047823 published May 11, 2006, WO06/076777 published Jul. 27, 2006, WO06/096920 published Sep. 21, 2006, and WO07/124,539 published Nov. 8, 2007, all of which are incorporated herein by reference.

Nonetheless, the development of wireless blasting systems, and components thereof, presents a formidable technological challenge. In just one example, selective control and firing of wireless detonators in pre-determined groups (as discussed above in the context of wired blasting systems) is not simple to achieve since there are no harness wires present for selective connection of the detonators. Hence there is a need in the art for methods of blasting that permit selective control of detonators and their corresponding wireless detonator assemblies, in the context of wireless blasting systems for mining.

SUMMARY OF THE INVENTION

Accordingly, in one embodiment the present invention provides a method of controlling a predetermined group of wireless initiation devices within a plurality of such devices at a blast site, which method comprises: transmitting to the plurality of wireless initiation devices a wireless command signal relating to some operation intended to be executed by the predetermined group of wireless initiation devices; for each wireless initiation device receiving the wireless command signal, determining whether the wireless initiation device forms part of the predetermined group; and for each wireless initiating device that determines that it forms part of the predetermined group, executing the operation on the basis of the command signal.

Thus, in accordance with this embodiment of the invention the wireless command signal is transmitted to (and received by) a plurality of wireless initiation devices, but only a predetermined group (or number) of the plurality of devices execute an (intended) operation on the basis of the signal. In embodiments of the present invention the wireless command signal comprises a component (group identification component) that allows each wireless initiation device receiving the signal to undertake analysis to determine whether that device forms part of the predetermined group. The nature of the group identification component is discussed in more detail below.

Optionally, the wireless initiation device may take the form of a wireless electronic booster by further comprising for example an associated explosive charge, such that actuation of the device causes actuation of each associated explosive charge. Such wireless electronic boosters may have alternative configurations or include other components, and are disclosed for example in international patent publication WO07/124,539 published Nov. 8, 2008, which is incorporated herein by reference.

Thus, in another embodiment of the present invention there is provided a method of controlling a predetermined group of wireless electronic boosters within a plurality of such boosters at a blast site, which method comprises: transmitting to the plurality of wireless electronic boosters a wireless command signal relating to some operation intended to be executed by the predetermined group of wireless electronic boosters; for each wireless electronic booster receiving the wireless command signal, determining whether the wireless electronic booster forms part of the predetermined group; and for each wireless electronic booster that determines that it forms part of the predetermined group, executing the operation on the basis of the command signal.

This embodiment relies on the same general principles as set out in relation to the first embodiment described, the difference being that the wireless electronic initiation device is a wireless electronic booster. In the following, unless otherwise stated or otherwise apparent, aspects of the present invention associated with the first embodiment described also apply in relation to the embodiments relating to the wireless electronic booster.

Also provided herein are a series of definitions that will assist an understanding of the present invention.

Definitions

"Actuate" or "initiate"—refers to the initiation, ignition, or triggering of explosive materials, typically by way of a primer, detonator or other device capable of receiving an external signal and converting the signal to cause deflagration of the explosive material.

"Automated/automatic blasting event"—encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

"Base charge"—refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

"Blasting machine"—any device that is capable of being in signal communication with electronic detonators, for example to send ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device to collect detonator information and transfer the information to the blasting machine, such as a logger.

"Wireless Electronic Booster"—refers to any device that can receive wireless command signals from an associated blasting machine, and in response to appropriate signals such as a wireless signal to FIRE, can cause actuation of an explosive charge that forms an integral component of the booster. In this way, the actuation of the explosive charge may induce actuation of an external quantity of explosive material, such as material charged down a borehole in rock. In selected embodiments, a booster may comprise the following non-limiting list of components: a detonator comprising a firing circuit and a base charge; an explosive charge in operative association with said detonator, such that actuation of said base charge via said firing circuit causes actuation of said explosive charge; a transceiver for receiving and processing said at least one wireless command signal from said blasting machine, said transceiver in signal communication with said firing circuit such that upon receipt of a command signal to FIRE said firing circuit causes actuation of said base charge and actuation of said explosive charge.

"Borehole"—generally refers to an elongate hole or recess, preferably cylindrical in form, drilled into a section of rock for loading, for example, explosive materials and initiation primers for actuating the explosive materials. However, boreholes may take any shape or form that is amenable to receiving explosive materials.

"Central command station"—refers to any device that transmits signals via radio-transmission or by direct connection, to one or more blasting machines. The transmitted signals may be encoded, or encrypted. Typically, the central blasting station permits radio communication with multiple blasting machines from a location remote from the blast site.

"Clock"—encompasses any clock suitable for use in connection with a initiation device, wireless electronic booster, wireless detonator assembly and blasting system, for example to time delay times for actuation of an explosive charge or material during a blasting event. In particularly preferred embodiments, the term clock relates to a crystal clock, for example comprising an oscillating quartz crystal of the type that is well know, for example in conventional quartz watches and timing devices.

"Control circuit"—refers to electronic circuitry that enables comparison to be performed between a received group identification that is stored in the memory component of a wireless initiation device or wireless electronic booster, and that is capable of determining whether the group identification component correlates with/matches the stored group identification. When it is determined that there is suitable correlation/matching the control circuit is also capable of implementing some operation of the device or booster on the basis of a wireless command signal. The control circuit is invariably an integrated circuit that is designed with at least the functionalities in mind.

"Explosive charge"—includes any discreet portion of an explosive substance contained or substantially contained within a booster. The explosive charge is typically of a form and sufficient size to receive energy derived from the actuation of a base charge of a detonator, thereby to cause ignition of the explosive charge. Where the explosive charge is located adjacent or near to a further quantity of explosive material, such as for example explosive material charged into a borehole in rock, then the ignition of the explosive charge may, under certain circumstances, be sufficient to cause ignition of the entire quantity of explosive material, thereby to cause blasting of the rock. The chemical constitution of the explosive charge may take any form that is known in the art such as TNT or pentolite.

"Explosive material"—refers to any quantity and type of explosive material that is located outside of a booster of the present invention, but which may be in operable association with the booster, such that ignition of the explosive charge within the booster causes subsequent ignition of the explosive material. For example, the explosive material may be located or positioned down a borehole in the rock, and a booster may be located in operative association with the explosive material down or near to the borehole. In preferred embodiments the explosive material may comprise pentolite or TNT.

"Group identification component"—refers to a part, portion, or component of a wireless command signal generated and transmitted by a blasting machine to one or more wireless devices (such as wireless detonators, wireless detonator assemblies, wireless electronic boosters etc.) at a blast site, wherein said part, portion, or component comprises a number, code, data packet, or other form of electronically transmitted information suitable receipt and processing by the one or more wireless devices, such that the wireless devices can compare the group identification component to a previously stored group identification, for example stored in each memory component of each wireless device. The electronic coding for the group identification component, at least in selected embodiments, may be identical to or substantially correspond to the electronic coding of the group identification to which it is intended to correspond. For example, if the group identification for each wireless detonator assembly in a given group of wireless detonator assemblies is a particular 8-bit decimal number (e.g. 12345678), then wireless command signals transmitted from a blasting machine and targeted to this group of wireless detonator assemblies may be "tagged" with a group identification component that corresponds to the group identification (e.g. 12345678). Alternatively, the group identification component may be different to the group identification component of the wireless devices to which it is targeted providing the wireless devices can process the incoming group identification components to appropriately determine their relevancy.

"Group identification" (or GID) —refers to any number, digit or group of digits (whether numerical, alphanumerical, or other), code, data packet, or other form of electronically transmitted or stored information suitable to assign a group identity to a wireless device (such as a wireless detonator, a wireless detonator assembly, or a wireless electronic booster) at a blast site. The group identification may be numerical, alphanumeric, other forms of code, or combinations thereof, and if numerical may be in any base including but not limited to binary, decimal, and hexadecimal. Each group identification is assigned to wireless devices and preferably suitable for storage in the devices such as for example via a memory component of the device. Group identifications assigned to a particular group of wireless devices may be identical (for simplicity of communication with the group) or may be non-identical. For example, if the group identifications for a particular group of wireless devices are non-identical then they may fall within a pre-determined range of group identifications, or group identifications of a particular group may pertain to even or odd numbers.

"Group identification programming signal"—refers to any signal derived from any component of a blasting apparatus, or other related device, that transmits to a wireless device (such as a wireless detonator, wireless detonator assembly, wireless electronic booster etc.) via wireless or wired connection a group identification to be programmed into the wireless device, and preferably stored by the memory of the wireless device. The group identification programming signal thus 'informs' one or more wireless devices of their group identity prior to the transmission of wireless command signals at the blast site. The group identification programming signal may be transmitted to each wireless device during factory assembly. Alternatively, the group identification programming signal may be transmitted to each wireless device at the blast site for example during set-up (for example by a portable programming device such as a logger) or after set-up prior to the execution of the blasting event in which case one or more group identification programming signals may for example be transmitted to the wireless devices by a blasting machine or other component of the blasting apparatus. A group identification programming signal may transmitted only once to each wireless device for one-time, permanent programming of each group identification into each wireless device. Alternatively, each group identification programming signal may be for semi-permanent or temporary programming of each wireless device with a group identification, such that the group identification of each wireless device may be removed, changed, or replaced during one particular blasting event, between blasting events, or at some other time.

"Instruction component"—refers to a part, portion, or component of a wireless command signal generated and transmitted by a blasting machine to one or more wireless devices (such as wireless detonators, wireless detonator assemblies, wireless electronic boosters etc.) at a blast site, wherein said part, portion, or component comprises a number, code, data packet, or other form of electronically transmitted information suitable receipt and processing by the one or more wireless devices, to provide the wireless device with instructions for a particular action. The action may be selected from the following non-limiting group of actions: ARM, DISARM, FIRE, ACTIVATE, DEACTIVATE, SHUTDOWN, CALIBRATE, STATUS CHECK, ROLL-CALL, ABORT, SYNCHRONISE etc. In accordance with the methods of the present invention, the instructions will only be carried out by the wireless device if the wireless device, upon comparison of the group identification component of the wireless command signal with the previously programmed group identification stored in the memory of the device, that the group identification component and the group identification correspond in some appropriate way.

"Logger/Logging device"—includes any device suitable for recording information with regard to components of the blasting apparatus of the present invention, such detonators. The logger may transmit or receive information to or from the components. For example, the logger may transmit data to detonators such as, but not limited to, detonator identification codes, delay times, synchronization signals, firing codes, positional data etc. Moreover, the logger may receive information from a detonator including but not limited to, detonator identification codes, delay times, information regarding the environment or status of the detonator, information regarding the capacity of the detonator to communicate with an associated blasting machine. Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines. One principal function of the logging device is to read the detonator so it can subsequently be "found" by an associated blasting machine, and have commands such as FIRE commands directed to it as appropriate. A logger may communicate with a detonator either by direct electrical connection (interface) or a wireless connection of any type.

"Network"—refers to wireless detonator assemblies in a blasting apparatus of the present invention in which at least one wireless detonator assembly is able to communicate via wireless communication means with a least one other wireless detonator assembly, thereby to create a network of intercommunicating wireless detonator assemblies at the blast site. The network of wireless detonator assemblies may include those that communicate directly with the one or more blasting machines at the blast site, which form an integral part of the blasting apparatus.

"Pre-programmed identification code"—refers to a detonator identification code that is assigned to a particular detonator or detonator assembly to separately identify each detonator assembly regardless of whether the detonator or detonator assembly is assigned to a particular group of detonators or detonator assemblies. Typically, a pre-programmed identification code may be programmed into a detonator or detonator assembly upon manufacture in a factory. Alternatively, a pre-programmed identification code may be assigned or programmed into each detonator or detonator assembly after manufacture, for example during set-up of a blast apparatus and placement of the detonators or detonator assemblies at a blast site. For example, a logger or other device may program a pre-programmed identification code into each detonator or detonator assembly at or following placement, to build a record of detonators present for the blast, and optionally further information regarding their operative environment, connections, location etc. This record or log may be downloaded to an associated blasting machine, thereby to provide the associated blasting machine with a detailed 'picture' of the blast set-up, and permit the blasting machine to individually address each detonator or wireless detonator assembly based upon its pre-programmed identification code. Each pre-programmed identification code may comprise any form of number, data packet, or electronic information in any form such as numerical, alphanumeric, other forms of code, or combinations thereof, and if numerical may be in any base including but not limited to binary, decimal, and hexadecimal. Each pre-programmed identification code may be associated with any particular detonator or detonator assembly via any means. For example, each pre-programmed identification code may be stored within a memory component of each detonator or detonator assembly, or may be stored as part of an RF-identification tag or other similar device affixed in some way to the detonator or detonator assembly.

"Pre-programmed identification code component"—refers to a part, portion, or component of a group identification programming signal generated and transmitted by a blasting machine to one or more wireless devices (such as wireless detonators, wireless detonator assemblies, wireless electronic boosters etc.) at a blast site, wherein said part, portion, or component comprises a number, code, data packet, or other form of electronically transmitted information suitable receipt and processing by the one or more wireless devices, such that the wireless devices can compare the pre-programmed identification component to a pre-programmed identification code (e.g. a factory programmed detonator ID), for example stored in each memory component of each wireless device. The electronic coding for the pre-programmed identification code component', at least in selected embodiments, may be identical to or substantially correspond to the electronic coding of the pre-programmed identification code to which it is intended to correspond.

"Preferably"—identifies preferred features of the invention. Unless otherwise specified, the term preferably refers to preferred features of the broadest embodiments of the invention, as defined for example by the independent claims, and other inventions disclosed herein.

"Protocol" refers generally to an agreed-upon method or format for processing or transmitting data within a device, by a device, or between two devices. A protocol may comprise a set of formal or predetermined decision points or rules. A protocol may also be defined as a convention or standard that controls or enables connection, communication, or data transfer between two endpoints, or may also be considered the rules governing the syntax, semantics, and synchronization of communication. Protocols may be implemented by hardware, software, or a combination of the two. In a basic form, a protocol defines the connection of two hardware devices or device components via wired or wireless communication, and establishes a structured set of rules or checkpoints for governing an order of decisions or events governing the communication. The definition of 'Protocol' is not limited to the present paragraph, and indeed other well known or commonsense definitions may also be applied. For example, reference may be made to established references such as Wikipedia and corresponding definitions for "protocol", "communications protocol", and "protocol (computing)" and references cited therein.

"Rock" includes all types of rock, including shale etc.

"STRATABLAST™"—refers to a type of blast that involves the fragmentation of multiple layers or levels or rock as for example described herein, or in accordance with the teachings of international patent publication WO2005/052499 published Jun. 5, 2005, which is incorporated herein by reference.

"Synchronize"—refers a signal or sequence of signals to co-ordinate or bring into temporal alignment the time bases or oscillators of a group of devices (e.g. wireless initiation devices), or the internal clocks of such devices.

"Top-box"—refers to any device forming part of a wireless detonator assembly that is adapted for location at or near the surface of the ground when the wireless detonator assembly is in use at a blast site in association with a bore-hole and explosive charge located therein. Top-boxes are typically located above-ground or at least in a position in, at or near the borehole that is more suited to receipt and transmission of wireless signals, and/or for relaying these signals to the detonator down the borehole. In preferred embodiments, each top-box comprises (one or more selected components of the wireless detonator assembly of the present invention.

"Wireless detonator assembly"—refers in general to an assembly encompassing a detonator, most preferably an electronic detonator (typically comprising at least a detonator shell and a base charge) as well as wireless signal receiving and processing means to cause actuation of the base charge upon receipt by said wireless detonator assembly of a wireless signal to FIRE from at least one associated blasting machine. For example, such means to cause actuation may include signal receiving means, signal processing means, and a firing circuit to be activated in the event of a receipt of a FIRE signal. Preferred components of the wireless detonator assembly may further include means to wirelessly transmit information regarding the assembly to other assemblies or to a blasting machine, or means to relay wireless signals to other components of the blasting apparatus. Other preferred components of a wireless detonator assembly will become apparent from the specification as a whole. The expression "wireless detonator assembly" may in very specific embodiments pertain simply to a wireless signal relay device, without any association to an electronic delay detonator or any other form of detonator. In such embodiments, such relay devices may form wireless trunk lines for simply relaying wireless signals to and from blasting machines, whereas other wireless detonator assemblies in communication with the relay devices may comprise all the usual features of a wireless detonator assembly, including a detonator for actuation thereof, in effect forming wireless branch lines in the wireless network. A wireless detonator assembly may further include a top-box as defined herein, for retaining specific components of the assembly away from an underground portion of the assembly during operation, and for location in a position better suited for receipt of wireless signals derived for example from a blasting machine or relayed by another wireless detonator assembly. Top-boxes are disclosed, for example, in international patent publication WO2006/076777 published Jul. 27, 2006, which is incorporated herein by reference.

"Wireless"—refers to there being no physical connections (such as electrical wires, shock tubes, LEDC, or optical cables) connecting the detonator of the invention or components thereof to an associated blasting machine or power source.

"Wireless electronic delay detonator" or '(WEDD)'—refers to any electronic delay detonator that is able to receive and/or transmit wireless signals to/from other components of a blasting apparatus. Typically, a WEDD takes the form of, or forms an integral part of, a wireless detonator assembly as described herein.

"Wireless initiation device"—refers to any device and associated components that achieve initiation of an associated base charge via receipt of wireless command signals. Such devices typically include detonators or detonator assemblies, optionally comprising one or more top-boxes, power sources, associated antennae etc.

DETAILED DESCRIPTION OF THE DRAWINGS

FIG. 1 schematically illustrates a perspective view of the surface of an area of ground, in which there have been established adjacent groups of boreholes.

Figure 2A:
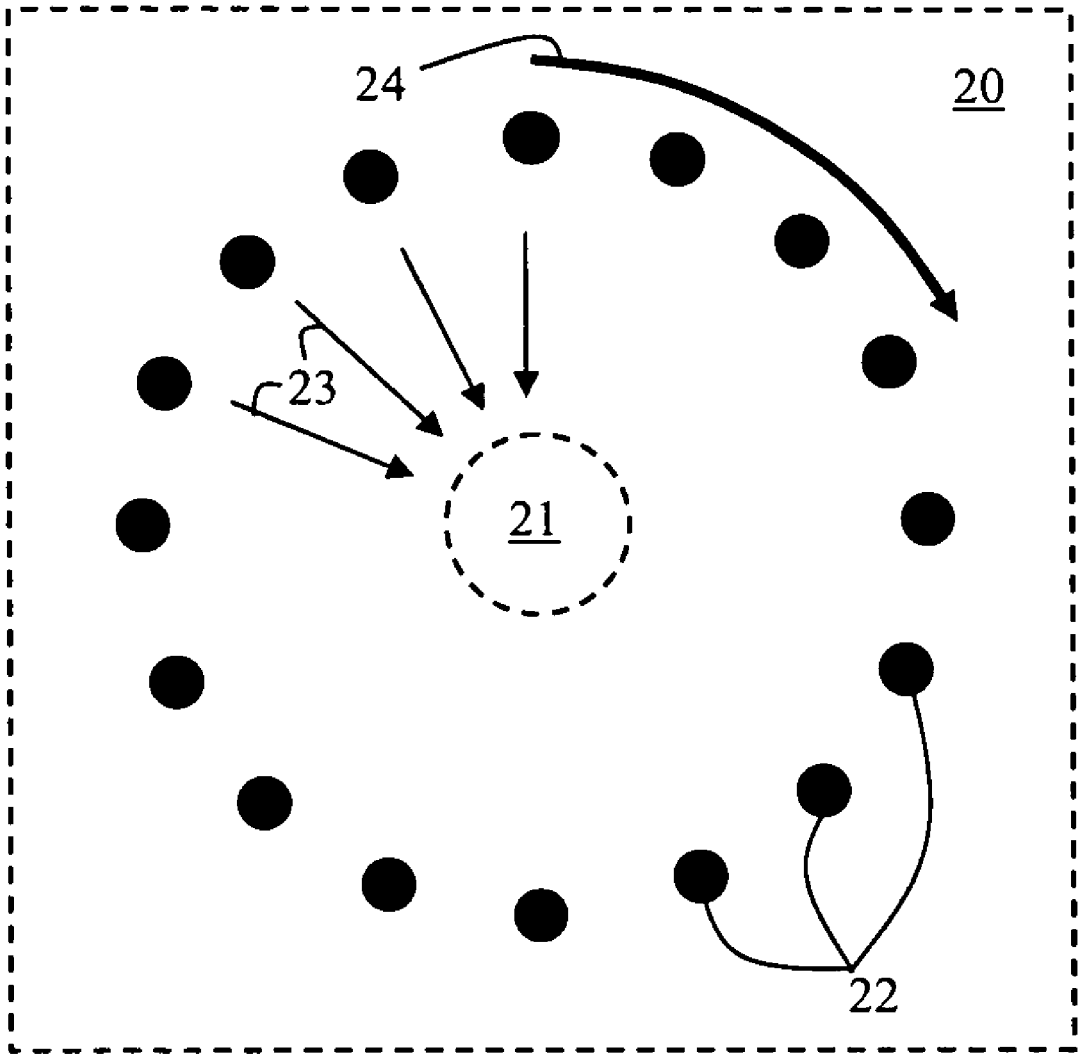

FIG. 2*a* schematically illustrates a front elevational view of an area of rock to be blasted underground for the purposes of extracting rock from a mineral seam or forming a tunnel.

Figure 2B:
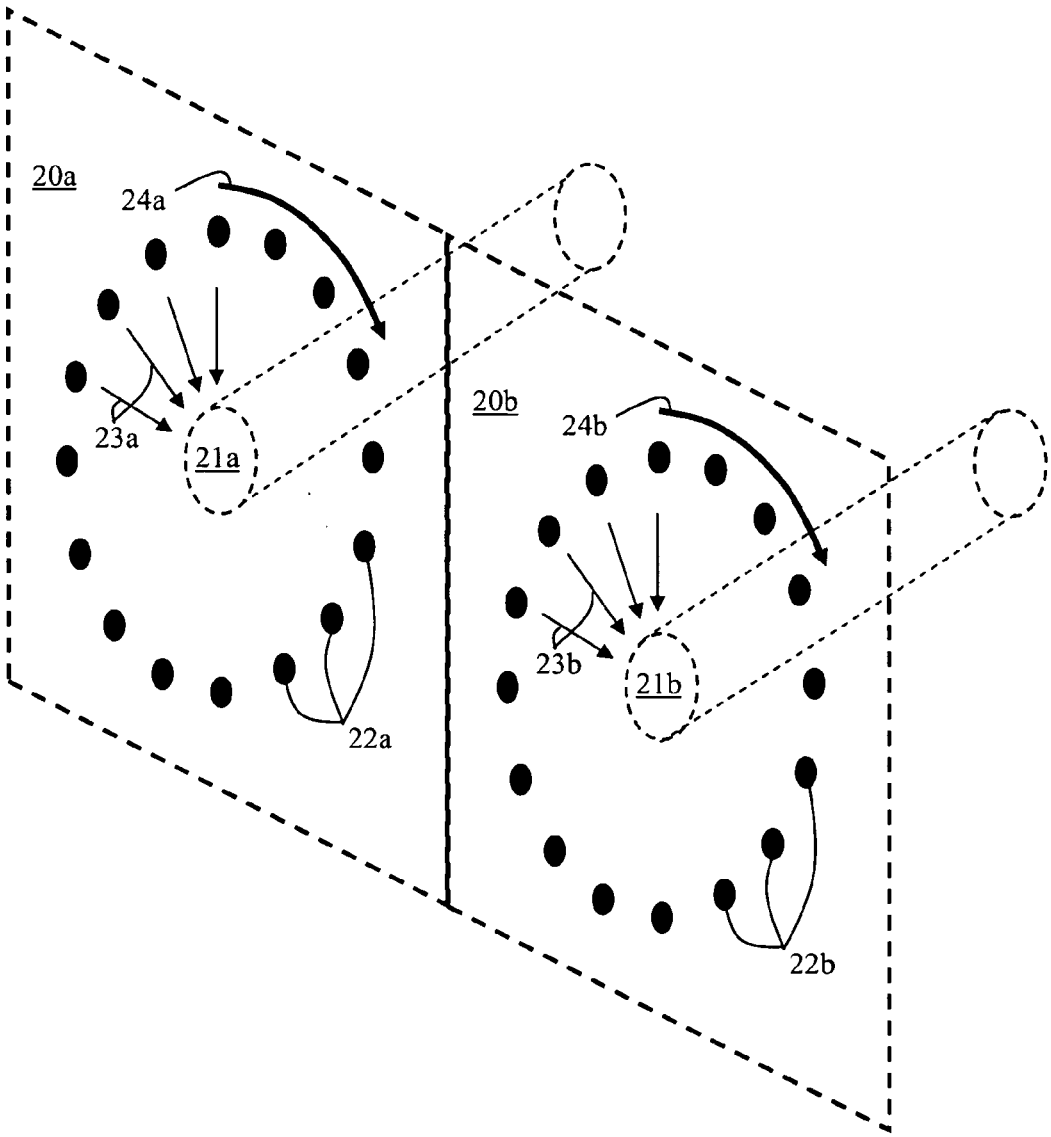

FIG. 2*b* schematically illustrates a perspective view of a face of rock to be blasted underground for the purposes of extracting rock from a mineral seam or forming a tunnel.

Figure 3:
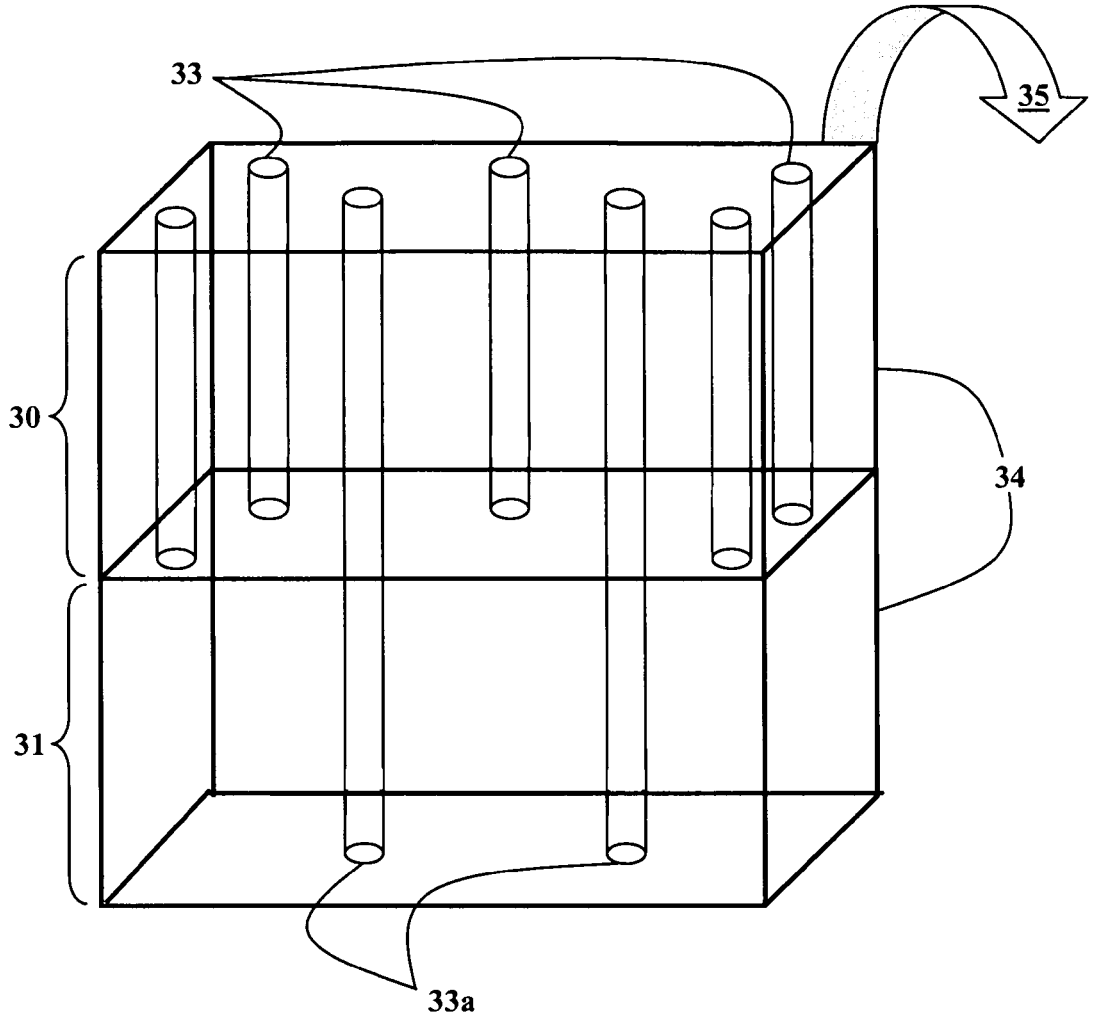

FIG. 3 schematically illustrates a perspective view of an overburden of rock and a mineral seam to be subjected to a Stratablast.

FIG. 4 schematically illustrates a side cross-sectional view of a shaft being formed by the half-face sinking method.

DETAILED DESCRIPTION OF THE INVENTION

The inventors have succeeded in the development of methods for the selective control of groups of wireless initiation devices or wireless electronic boosters at a blast site. In particular, these methods may be applied to wireless blasting systems wherein the devices or boosters communicate with one or more control units (i.e. blasting machines) via wireless communication at a blast site. The methods may be applied to blasting systems that employ any type of wireless electronic device for blasting, but will be described herein with reference to wireless initiation devices and wireless electronic boosters. The methods of the invention are not limited to a particular type of blasting or a particular type of rock. Indeed, the methods may be used for surface and/or underground blasting.

The methods of the present invention generally involve transmission of one or more wireless command signals to a plurality of wireless initiation devices or wireless electronic boosters, wherein selected wireless command signals are each targeted only to a pre-selected group of devices or boosters at the blast site. By 'tagging' each wireless command signal with an additional data element, each device or booster may 'recognize' whether or not the wireless command signal is intended for the device or booster, and whether or not the device or booster must undertake a required action associated with the signal.

As noted the nature/content of the wireless command signal is an important aspect of the present invention. In one embodiment the wireless command signal comprises a group identification component that enables differentiation of wireless initiation devices (or wireless electronic boosters) forming part of the predetermined group from wireless initiating devices (or wireless electronic boosters) not forming part of the predetermined group, and wherein each wireless initiation device (or wireless electronic booster) comprises: a receiver for receiving a wireless command signal; a memory component in which is stored a group identification; and a control circuit for comparing the group identification component with the stored group identification, for determining on the basis of that comparison whether the wireless initiation device (or wireless electronic booster) forms part of the predetermined group, and for executing the intended operation of the wireless initiation device (or wireless electronic booster) if it is determined that it forms part of the predetermined group.

It is evident from this embodiment that the wireless initiation device (or wireless electronic booster as the case may be) includes componentry, i.e. a receiver, for receiving a wireless command signal. This may be of conventional form and is operated in conventional manner. Although not stated above the wireless command signal is typically transmitted to the plurality of devices (or boosters) by at least one blasting machine.

The device (or booster) also includes a memory component in which is stored a group identification for that device (or booster). The memory typically forms part of an integrated circuit associated with the device (or booster). The use of memory components to store identification data is common in the detonator art and one skilled in the art would be familiar with hardware that may be used.

Related to the nature/content of the wireless command signal in this embodiment the device (or booster) includes a control circuit. One function of this control circuit is to compare the group identification component of a received wireless command signal with the group identification stored in the memory component and to determine on the basis of that comparison whether the device (or booster) that has received the signal forms part of the predetermined group of devices (or boosters) that are intended to execute on operation on the basis of the signal. Thus, there is an operative relationship between the receiver, the control circuit and the memory component, and between the control circuit and ancillary components that are responsible for operation of the device (or booster). Typically, the control circuit will comprise an integrated circuit designed to perform these functionalities.

In one case the plurality of wireless initiation devices (or wireless electronic boosters) are divided into predetermined groups, with wireless initiation devices (or wireless electronic boosters) within the same predetermined group having the same stored group identification, and with wireless initiation devices (or wireless electronic boosters) in different predetermined groups having different stored group identifications, the group identification component of said wireless command signal corresponding to a group identification. In this case a single group identification component of the command signal is used to identify a predetermined group of devices (or boosters).

In another case, each wireless initiation device (or wireless electronic booster) in the plurality of wireless initiation devices (or wireless electronic booster) has a unique stored group identification, and wherein the group identification component of the wireless command signal comprises a plurality group identification components corresponding to group identifications for the predetermined group of wireless initiation devices (or wireless electronic boosters). Here each device (or booster) has a different stored group identification and the wireless command signal comprises a plurality of group identification components that collectively relate to those devices (or boosters) forming the predetermined group.

In a variation, following placement of each wireless initiation device (or wireless electronic booster) at the blast site, all components of the device (or booster) are checked for operative integrity, and wherein the group identification for each wireless initiation device (or wireless electronic booster) is programmed into the memory component in situ at the blast site during the check. Alternatively, each wireless initiation device (or wireless electronic booster) has a pre-stored factory identification code, and wherein each group identification is a separate identity element for each wireless initiation device (or wireless electronic booster) that is programmed into the memory component in situ at the blast site.

In these various embodiments programming can be performed using one or more blasting machines by wireless signal transmission, or via short range wired or wireless communication using a portable programming device.

When the device (or booster) has a pre-stored factory identification code, programming of the group identification for each wireless initiation device (or wireless electronic booster) comprises: transmitting a wireless group identification programming signal comprising (i) a factory identification code component and (ii) a group identification component to each wireless initiation device (wireless electronic booster); for each wireless initiation device (or wireless electronic booster) receiving the factory identification code component, comparing the received factory identification code to its pre-stored factory identification code; and for each wireless initiation device (or wireless electronic booster) that determines that the factory identification code component corresponds to its pre-stored factory identification code, storing in the memory component the group identification component as a group identification. The control circuit of the device (or booster) may perform the necessary comparison and cause storage of the group identification component, as necessary.

In a further variation the group identification of each wireless initiation device (or wireless electronic booster) corresponds to a factory programmed identification code of each wireless initiation device (or wireless electronic booster).

According to an embodiment of the present invention the method further comprises deactivating or shutting-down each wireless initiation device (or wireless electronic booster) that determines that it does not fall within the predetermined group.

The wireless command signal will generally also include an instruction component that relates to one or more operations to be executed by the wireless initiation device (or wireless electronic booster). Typically, the wireless command signal comprises a command selected from a command signal to FIRE the wireless initiation device (or wireless electronic booster), a command to ARM the wireless initiation device (or wireless electronic booster), a command to DISARM the wireless initiation device (or wireless electronic booster), a command to ACTIVATE the wireless initiation device (or wireless electronic booster), a command to DEACTIVATE the wireless initiation device (or wireless electronic booster), a command to SHUT-DOWN the wireless initiation device (or wireless electronic booster), and a command to CALIBRATE an internal clock of the wireless initiation device (or wireless electronic booster).

The methods of the present invention, at least in their most general forms, may be applied to a very wide variety of blasting techniques and methodologies, including many techniques that are already known in the art, but which traditionally employ wired harness systems for selective control and initiation of devices at a blast site. Examples of such blasting techniques, and the application of the methods of the present invention to such techniques, will be discussed below in more detail (see Examples).

Nonetheless, a skilled artisan will appreciate that the methods of the present invention are not only useful in the application of wireless blasting systems to known blasting techniques. Indeed, the methods of the present invention provide an excellent platform for the development of entirely new blasting techniques that require a combination of (1) wireless control of initiation devices, and (2) selective control of the devices in groups at a blast site.

In one particular embodiment of the invention, there is provided a method of controlling a plurality of wireless initiation devices at a blast site, each in wireless signal communication with at least one blasting machine that transmits wireless command signals, each wireless initiation device comprising: at least one detonator comprising a firing circuit and a base charge; a memory component; and a receiver for receiving at least one wireless command signal from the at least one blasting machine, said receiver in signal communication with each firing circuit such that upon receipt of a command signal to FIRE said firing circuit causes actuation of the base charge of each detonator; the method comprising the steps of: (1) programming each wireless initiation device with a group identification to be stored in the memory component thereof; and (2) transmitting from the at least one blasting machine to the wireless initiation devices a wireless command signal directed only to a predetermined group of wireless initiation devices, the wireless command signal comprising (i) an instruction component and (ii) a group identification component; (3) each wireless initiation device receiving the wireless command signal and comparing the group identification component to its group identification thereby to determine whether each wireless initiation device falls within said predetermined group; and (4) for each wireless initiation device that positively determines in step (3) that it falls within said predetermined group, executing said instruction component of the wireless command signal.

In the following the features described with reference to this particular embodiment may, unless context otherwise dictates, be applicable to the other methods of the invention have already been described.

Regardless of the application of the methods disclosed herein, this particular embodiment of the invention requires:

(1) that each wireless device at the blast site be programmable with a group identification, and that each wireless device recognize whether an incoming wireless command signal is appropriately 'tagged' with a corresponding group identification component; and (2) that each associated blasting machine is able to transmit wireless command signals that each include an appropriate 'tag', otherwise referred to herein as a group identification component, for recognition or otherwise by each wireless device receiving the signal.

In this way, the methods of the invention permit wireless initiation devices at a blast site to be controlled and optionally fired in separate groups in the absence of physical connections to a control unit such as a blasting machine. The groups of devices may be located generally separate from one another, such as in rings ('ring-blasting') or in rows. Alternatively, the groups may be inter-mingled. If the devices include detonators, the detonators within one group may be fired simultaneously, or with delays relative to one another, each detonator or corresponding assembly being programmable with a delay time. In this way, detonators may be fired in separate groups, with each group having a pre-determined blasting pattern.

The detonators may also be pre-programmed with individual pre-programmed identification codes and/or firing codes, that are optionally programmed upon manufacture of the detonators in a factory. Thus, in certainly exemplary embodiments any group identification assigned to a detonator may optionally be in addition to any other identification or firing codes already assigned to and programmed into the detonator.

In other exemplary embodiments one or more groups of detonators may be organized into a cross-communicating network of wireless initiation devices as disclosed for example in international patent publication WO06/076777 published Jul. 27, 2006, which is incorporated herein by reference.

Each group identification programmed into each wireless initiation device in step (1) effectively assigns each wireless initiation device into a particular group. The group identification is first programmed into the wireless initiation device. Subsequently, the group identification is later used in conjunction with other components of the blast apparatus to control the group of wireless initiation devices together at the blast site.

In step (2) of the method, the instruction component of the wireless command signal typically includes the 'usual' commands that a wireless initiation device would be expected to respond to in the field. Such instructions or commands may include for example a signal to FIRE the wireless initiation device, a command to ARM the wireless initiation device, a command to DISARM the wireless initiation device, a command to ACTIVATE the wireless initiation device, a command to DEACTIVATE the wireless initiation device, a command signal to ABORT any operation of the wireless initiation device (or ABORT the blast), and a command signal to CALIBRATE and internal clock of a wireless initiation device. Notably, however, and in accordance with the intentions of the method, each wireless initiation device will be only be able to carry out and 'respond' to the instruction component of the command signal if the wireless initiation device 'recognizes' that the command signal is specifically target to and intended for that wireless initiation device. This 'recognition' is enabled by way of step (1), whereby each wireless initiation device is initially programmed with a group identification, together with step (3) whereby each wireless initiation device analyses each incoming wireless command signal by comparing a group identification component thereof with its own, previously programmed group identification. If the group identification previously programmed into the wireless initiation device in step (1) and the group identification component received in step (3) correspond, then the wireless initiation device is activated to 'respond' to the wireless command signal by carrying out the instructions provided by way of the instruction component of the command signal. Optionally, if a wireless initiation device determines that its previously programmed group identification does not correspond to a group identification component of a received wireless command signal then the wireless initiation device may default into temporary or permanent deactivation in which the device is effectively on stand-by pending receipt of a wireless command signal that is intended to be actioned by the device, or shut-down completely.

The group identification may take any form and be programmed into the wireless initiation device in any way. In one exemplary embodiment the grouping of the wireless initiation devices may involve programming of the members of a particular group with the same group identification, with members from different groups being programmed with different group identifications. Each associated blasting machine is 'aware' of the groups present, and the group identifications allocated thereto, for subsequent transmission of wireless command signals to control and if required fire the detonators or detonator assemblies of each group.

In other exemplary embodiments each wireless initiation device may be programmed with a group identification that is unique and specific for that wireless initiation device. In such embodiments the group identification may be separate to or perhaps even the same as any pre-programmed (e.g. factory programmed) identification number for each detonator or wireless initiation device. Under these circumstances, grouping of the detonators or wireless initiation devices may be designated by the associated blasting machine, and controlled accordingly. For example, a blasting machine or other device may control a first group of wireless initiation devices as those designated with group identifications 1 to 50, with a second group as those designated with group identifications 51-100 and so forth. In another example, a blasting machine or other device may designate a first group of wireless initiation devices as those with even-numbered group identifications, with a second group as those with odd-numbered group identifications. One advantage of this type of arrangement is that a blasting machine or other device may reorganize or re-designate the groupings of the wireless initiation devices, even after set-up at the blast site, without difficulty. This may be done by re-assigning the group identifications. However, the wireless command signals produced and transmitted by the blasting machines are necessarily more complex since a single wireless command signal directed to a plurality of wireless initiation devices within a group must necessarily include all group identifications for all assemblies in the group.

Step (1) of the method, which involves programming of each wireless initiation device with a group identification, may be carried out at any time. For example, group identifications may be programmed in the factory upon manufacture of the wireless initiation devices. Alternatively, group identifications may be programmed just prior to, during or just after set-up of a blasting apparatus at a blast site. For example, in one embodiment each wireless initiation device may be placed at a desired position at the blast site, optionally in association with an explosive charge, and immediately following or soon after placement the wireless initiation device may be 'visited' with a portable programming device such as a logger. The logger may communicate with each wireless initiation device via a direct electrical connection or via a short range wireless connection such as an infrared or Bluetooth connection. In this way, each wireless initiation device or each detonator thereof may be programmed by the logger with information such as: a group identification, a delay time etc. In further embodiments, the logger may retrieve information about each wireless initiation device or each associated detonator such as for example, a previously programmed group identification, a pre-programmed identification number (such as one that has been factory programmed), a position of each wireless initiation device etc. Once the logger has visited each wireless initiation device at the blast site, it may then be connected to one or more blasting machine, and the information relating to the wireless initiation devices present at the blast site may be downloaded to the blasting machine (s). For example, each blasting machine may receive information regarding each wireless initiation device present at the blast site so that it can obtain an overall 'picture' of the blast site including the relative positions of the wireless initiation devices present, their delay times, and their groupings. In selected embodiments, the blasting machine may have the option, once in possession of this information, to reallocate detonator groupings for example to achieve a more efficient and effective blast.

Thus, in certain embodiments the set-up of wireless initiation devices and the at least one blasting apparatus at the blast site may involve a placement phase for device placement, such that step (1) of programming comprises the steps of:

(1a) placing each wireless initiation device at a desired position at the blast site; and (1b) programming each wireless initiation device via short range wired or wireless communication from a portable programming device with a group identification.

In other selected embodiments, step (1) of the method may take place following set-up of the blast apparatus at the blast site, and positioning of the wireless initiation devices. For example, once a blasting apparatus has been established at a blast site it may typically undergo a "status check" prior to executing the blasting event to check that all components of the blasting apparatus (including all wireless initiation devices and blasting machines) are active, properly operating, and in full wireless communication with one another. During this initial phase each blasting machine may take a roll-call of associated wireless initiation devices, whereby a roll-call or check signal is transmitted by each blasting machine to each associated wireless initiation device, and each wireless initiation device 'responds' to confirm that all is well (or otherwise). This type of roll-call presents a useful opportunity to program each wireless initiation device with a group identification. For example, each roll-call signal transmitted by a blasting machine may comprise or be accompanied by a wireless initiation device identification number (so that each the roll-call signal can be properly targeted to and recognized by its intended wireless initiation device). Each roll-call signal may further include an additional component by way of a group identification programming component for receipt and processing by each wireless initiation device. For example, when a particular wireless initiation device receives a roll-call signal, it may first compare the wireless initiation device identification component of the signal with its own previously programmed (e.g. factory programmed) identification number to determine whether it is supposed to react to the roll-call signal. When the wireless initiation device positively determines that it must respond to the roll-call signal (because it is intended for that particular wireless initiation device) the wireless initiation device may then receive and process the additional group identification programming component thereby to achieve step (1) of the method. In this way, the each blasting machine is responsible for programming each of its associated wireless initiation devices with a group identification.

Thus, in certain exemplary embodiments of the invention each wireless initiation device may have programmed therein a factory programmed identification code, such that the group identification is a secondary identity element for each wireless initiation device programmed in situ at the blast site. According to such embodiments, step (1) of programming may be broken down into the steps of:

(1a) transmitting from said at least one blasting machine to each wireless initiation device of a group identification programming signal comprising (i) a pre-programmed identification code component and (ii) a group identification component;

(1b) each wireless initiation device receiving and comparing the pre-programmed identification code component to its pre-programmed identification code; and (1c) for each wireless initiation device that positively determines in step (1b) that the pre-programmed identification code component corresponds to its pre-programmed identification code, storing said group identification component as a group identification in said memory component.

Turning now to step (2) of the method, which involves transmitting a wireless command signal from the at least one blasting machine to the wireless initiation devices, it should be noted that any form of wireless signaling may be utilized. Typically, such wireless command signals may comprise a form of electromagnetic energy such as radio waves, visible light (e.g. laser light) UV etc. Radio waves are particularly preferred, and for applications that involve underground placement of wireless devices and through-rock signaling, LF, VLF or ELF radio signals may be preferred. Other forms of energy may be used for wireless signaling, including but not limited to acoustic energy. Furthermore, the instructional component of each wireless command signal may provide any form of instructions to a wireless initiation device or other wireless device at the blast site. Such instructions may include, but are not limited to, instructions to calibrate an internal clock of the device, instructions to ARM, DISARM, FIRE, SHUT-DOWN, ACTIVATE, DEACTIVATE, SYNCHRONIZE or REACTIVATE the device, or instructions to ABORT an already activated firing sequence.

In steps (3) and (4) of the method each wireless initiation device makes a comparison between a received group identification component (being a component part of the wireless command signal) and a previously programmed group identification stored in the memory of the assembly. If these correspond then this provides positive verification that the wireless initiation device falls within a group of wireless initiation devices to which the wireless command signal is intended and directed, so the wireless initiation device may take action based upon the instructional component of the command signal. However, any method of the present invention may include the further step of deactivating or otherwise shutting down each wireless initiation device that does not fall within the group. In this way, wireless initiation devices may be activated and optionally deactivated in groups according to whether they fall within or outside of a pre-determined group of devices at the blast site. Activation of selected wireless initiation devices, and deactivation or other wireless initiation devices at the blast site may occur simultaneously, or sequentially in any order.

It should be noted that each group identification may take any form that permits one group identification to be differentiated over another. For example, each group identification may comprise numeric, alphanumeric, or other characters. Group identifications may further comprise binary, decimal, hexadecimal or any other base. Further group identification may comprise any number of bits, although 4 to 8 bits may be preferred in some instances to provide a signal complex enough for group identification differentiation, and yet not too complex for transmission, for example, through-rock.

Optionally, the wireless initiation device may take the form of a wireless electronic booster by further comprising for example an explosive charge in operative association with each detonator, such that actuation of each base charge causes actuation of each associated explosive charge. Such wireless electronic boosters may have alternative configurations or include other components, and are disclosed for example in international patent publication WO07/124,539 published Nov. 8, 2008, which is incorporated herein by reference.

Thus, in another particular embodiment there is provided a method of controlling a plurality of wireless electronic boosters at a blast site, each in wireless signal communication with at least one blasting machine that transmits wireless command signals, each wireless electronic booster comprising: at least one detonator comprising a firing circuit and a base charge; a memory component; a receiver for receiving at least one wireless command signal from the at least one blasting machine, said receiver in signal communication with each firing circuit such that upon receipt of a command signal to FIRE said firing circuit causes actuation of the base charge of each detonator; and optionally an explosive charge in operative association with each detonator, such that actuation of each base charge causes actuation of each associated explosive charge; the method comprising the steps of: (1) programming each wireless electronic booster with a group identification to be stored in the memory component thereof; and (2) transmitting from the at least one blasting machine to the wireless electronic boosters a wireless command signal directed only to a predetermined group of wireless electronic boosters, the wireless command signal comprising (i) an instruction component and (ii) a group identification component; (3) each wireless electronic booster receiving the wireless command signal and comparing the group identification component to its group identification thereby to determine whether each wireless electronic booster falls within said predetermined group; and (4) for each wireless electronic booster that positively determines in step (3) that it falls within said predetermined group, executing said instruction component of the wireless command signal. It will be appreciated that additional aspects and features of the methods of the invention already described may also be applicable in the context of this method relating to the use of wireless electronic boosters.

The invention will now be further described with reference to various examples and corresponding figures. These examples and figures are merely illustrative of preferred embodiments of the invention, in part to demonstrate the wide variety of blasting techniques to which the invention may be successfully and usefully applied in the field. Many other methods and blasting techniques that employ wireless signalling may also be conducted in accordance with the teachings herein.

EXAMPLE 1

Protocol Design Options for Selective Blasting in Groups

In accordance with selected embodiments of the present invention, a blasting apparatus that employs wireless initiation devices may be established at a blast site. As discussed, the wireless initiation devices may take any form, including wireless electronic boosters, or wireless initiation devices optionally including top-boxes. The group identifications may be pre-programmed into the wireless initiation devices prior to placement at the blast site. Therefore, various protocol options are available to program the devices with group identifications, following by selective blasting.

Typically, during a blasting event each wireless initiation device at the blast site may be contacted several times by an associated communicating device such as a blasting machine. Corresponding wireless signals transmitted to the devices may include, but are not limited to, command signals for:

STATUS CHECK (to confirm that the device is operating normally);

CALIBRATION (to calibrate internal clocks of the devices);

DELAY TIME PROGAMMING SIGNAL (to program delay times);

ARM (to arm the devices ready to receive an initiation signal);

FIRE (to initiate the armed devices);

wherein at least the initial three signals/steps may be transmitted or performed in any order.

The protocol to control a blasting apparatus may be designed in accordance with the requirements of selective control and initiation of devices at the blast site. For example, blast site regulations may require that only a certain number of devices be initiated at once, for example to reduce unwanted ground vibrations. In some circumstances it may be desirable to 'tag' each and every command signal with a corresponding group identification component for receipt and analysis by each wireless initiation device, wherein each device will only respond to and act in accordance with the requirements of the command signal if the group identification component of each received command signal corresponds with the group identification of the device.

However, for the sake of simplicity it is not necessary for each and every command signal to be tagged with a group identification component. For example, selected protocols may only require that the ARM signal include a group identification component. In this scenario the protocol for the communication between the blasting machine and the devices would occur as follows:

STATUS CHECK signal to all devices at the blast site to confirm that all devices present are operating normally;

CALIBRATION signal to all devices at the blast site to calibrate internal clocks of the devices;

DELAY TIME PROGAMMING SIGNAL to each device at the blast site to program delay times for the devices;

ARM signal including GROUP IDENTIFICATION COMPONENT to arm a select group of the devices ready to receive an initiation signal;

FIRE signal transmitted and received universally by all devices, but only processed by those devices that have already been armed, which devices were previously selected due to the ARM signal including a group identification component, thereby to initiate the selected group of devices.

Alternatively, the FIRE signal instead of the ARM signal may be tagged with an associated group identification component. This protocol may be preferred where it is desirable to ARM all devices with an ARM signal, and then leave the selection of those devices to be initiated by a FIRE signal until the last step of the protocol.

In accordance with such protocols there are several opportunities for each wireless device to be rejected from a blasting event. For example, rejection may occur when the status check indicates that a device is not functioning properly, or if a device is not fully responsive to proper calibration or delay time programming. Furthermore a device may be rejected from a blasting event if the device is not within the preselected group for a particular stage of the blast, for example if the device does not have a group identification corresponding to the group identification component of the ARM or FIRE signals (or other signals). Therefore, multiple checks are in place within any given protocol to ensure (1) proper functionality of each device, and (2) proper selection of each device within a particular group of devices selected for initiation at any given time.

Still further protocols may require that the group identification check be performed prior to any of the STATUS CHECK, CALIBRATION, DELAY TIME PROGAMMING, or other steps in the protocol. Such protocols may be useful to simplify subsequent communication with the initiation devices, since the group of devices will be effectively pre-selected before any status check and clock calibrations are carried out.

The nature and design of each blast protocol will depend upon various factors affecting the wireless initiation devices and associated components including blasting machines. For example, the design of each protocol will depend upon whether the wireless signals are transmitted above-ground or through-rock, or will depend upon the rock to be blasted, or the environment of the blast site or devices located at the blast site.

Subsequent examples will discuss various field applications of selective blasting of wireless initiation devices, and the circumstances of each field application will also influence protocol design and application. Regardless of the field application and the precise nature of the protocol to be used, the methods of the present invention permit blast operators to drill and load boreholes for several blast cycles at once.

The blast operators may then remove themselves from the vicinity of the blast site, and execute each 'cycle' or phase of the blast from a remote location without need to revisit the blast site between the cycles, with clear safety benefits. Furthermore, by establishing several blast cycles at once the methods of the present invention permit the establishment of very large blasts using wireless initiation devices, with the blast being broken down into several, separate stages according to the grouping of the wireless initiation devices.

Traditional wired blasting arrangements present still further challenges for very large blasts. Copious lengths of wire at the blast site can result in high levels of current leakage, resistance, capacitance, electrical noise etc. in the wires and wireless connections. In contrast, the methods of the invention provide excellent opportunities to control and execute very large blasting events using perhaps many groups of wireless initiation devices. The complete absence of wires at the blast site (at least between a blasting machine and initiation devices) circumvents all of the issues described above with regard to current leakage, resistance, capacitance, electrical noise etc. that are inherent to larger wired arrangements. Hence, the methods of the present invention, at least in selected embodiments, facilitate the establishment and execution of very large blasting events involving dozens, hundreds or even thousands of initiation devices, selectively controlled in groups via wireless signals.

EXAMPLE 2

Surface Blasting of Wireless Initiation Devices in Groups

Certain exemplary embodiments of the methods of the present invention may be applied to surface blasting techniques. Such examples will be described with reference to FIG. 1, which schematically illustrates a perspective view of the surface of an area of ground in which there have been established boreholes 10 established in an area of ground 11. The area 11 is divided into four sections A, B, C, and D each containing a plurality of boreholes, each borehole containing a wireless initiation device. Optionally a top-box (not shown) of the type that is known in the art may extend near to or above the surface of the ground at each borehole, with communication means extending from each top-box to other components of a wireless initiation device including a detonator (not shown) located down the borehole.

The methods of the present invention permit selective control and initiation of the wireless initiation devices in groups at the blast site. For example, command signals may be transmitted to ARM only those wireless initiation devices located in areas A and C of the blast site, so that the devices in those areas may be initiated in a separate stage to the blast compared to those in areas B and D. Alternatively, a blast operator may first choose to selectively control and initiate only those devices in area C, and depending upon the fragmentation and throw of the fragmented rock may only then make a decision regarding the next area of the ground to be blasted.

Therefore, the methods of the present invention permit the entire area of the ground 11 to be blasted in stages, with the blast operator selecting a group of wireless initiation devices to be initiated for each stage of the blast. In this way, the blast site may be established with a very large number of wireless devices, and yet those devices are divided and initiated in separately controllable groups: this has been difficult or impossible to achieve to date with wireless initiation systems for mining. Not only are ground vibrations reduced (because the blast is conducted in stages) but the need to re-visit the blast site between the stages of the blast is virtually eliminated, thus resulting in significant safety advantages.

Each of areas A, B, C, and D may be blasted milliseconds, seconds, minutes, hours or days apart depending upon the blast operation. Additionally, the devices within each area may be programmed with individual delay times in the usual manner to achieve a desired blasting pattern within each area of the ground.

The present example thus illustrates the safety and flexibility of selective blasting of wireless initiation devices in groups at a blast site. The advantages of the methods of the present invention extend beyond the mere absence of trailing wires. The selective addressability and initiation of wireless initiation devices at a blast site presents a significant step forwards for wireless electronic blasting, and opens the door to much large blasting events that employ wireless initiation devices.

EXAMPLE 3

Clock Calibration of Wireless Electronic Boosters Positioned Underground

The methods of the present invention may be applied to both surface mining and underground mining techniques. For example, the methods of the invention may be applied to wireless electronic boosters such those disclosed for example WO2007/124539 published Nov. 8, 2007, which is incorporated herein by reference. Techniques have been developed for clock calibration of such wireless electronic boosters when positioned underground for underground blasting, even though such calibration signals must be transmitted through-rock (see for example WO2007/124538 published Nov. 8, 2007, which is also incorporated herein by reference). Such complex signals are difficult to transmit successfully and without interference through rock. However, it should be noted that even calibration signals transmitted through-rock (or indeed other wireless command signals transmitted through rock) are amenable to being 'tagged' by a group identification component. The group identification component may be very simple indeed, and in its simplest form may comprise for example a single digit or bit of information, which can be readily associated with a clock-calibration or other signal, and successfully transmitted through rock to devices located underground at the blast site.

Thus in accordance with the teachings herein, wireless initiation devices may be selectively controlled and initiated regardless of their position relative to their source of command signals. Accurate, selective control of groups of wireless initiation devices, including wireless electronic boosters located underground, can be achieved in accordance with the methods of the invention.

EXAMPLE 4

Ring Blasting with Selective Initiation of Wireless Initiation Devices

Ring blasting techniques, more particularly for underground blasting, are well known in the art as disclosed for example in U.S. Pat. No. 4,601,518 issued Jul. 22, 1986, which is incorporated herein by reference. Typically, ring blasting is a technique used for extracting ore from a seam underground. FIG. 2*a* schematically illustrates a front elevational view of a wall of rock to be blasted, shown generally within area 20. In an initial stage, the central region may be optionally removed by a smaller blast or by boring into the wall of rock thereby to form a cavity 21. The cavity is suitable to receive dislodged and fragmented rock from subsequent initiation of explosive materials in the surrounding "ring" of boreholes 22, and associated initiation devices. Thus, actuation of detonators and their associated explosive charges within the boreholes causes fragmentation and movement of rock generally 'inwards' towards cavity 21 (i.e. in the direction of arrows 23), thereby to fragment and dislodge the rock in area 20, to expose a new wall of rock beyond. The presence of a cavity 21 is particularly preferred if all detonators and associated explosive charges in the ring are to be actuated at or near the same time. Ring-blasting techniques are also used in tunnel blasting to form a tunnel through or into rock.

It may also be noted that the initiation devices within boreholes 22 may be programmed with delay times so that they initiate in a desired pattern for 'rotational blasting'. A first detonator at a first position is the first to actuate, and then other detonators actuate progressively in a clockwise or anticlockwise direction around the ring (see arrow 24). Rotational blasting may be preferred in some instances to cause improved rock fragmentation and movement.

It may also be desirable to use wireless initiation devices such as wireless electronic boosters for underground ring blasting. Wireless electronic boosters may comprise a robust casing that is resistant to the forces of the blasting process.

FIG. 2*b* provides a perspective view to illustrate how ring blasting or rotational blasting may be carried out using more than one adjacent rings of boreholes, 22*a*, 22*b* each surrounding an associated cavity 21*a*, 21*b* (each cavity 21*a*, 21*b* is shown extending back into face 20*a*, 20*b*). The advantages of the methods of the present invention to ring blasting are thus apparent. By the invented methods, each ring of boreholes and associated wireless initiation devices can be separately controlled and initiated from above the ground. For example the ring of boreholes 22*a* in area 20*a* in FIG. 2*b* may be initiated first using delay times to achieve a rotational blast. Then, after several seconds, minutes or even hours, the second ring of boreholes 22*b* in area 20*b* in FIG. 2*b* may be initiated, again using delay times to achieve a rotational blast. Although not illustrates, still further rings of boreholes and associated explosive charges may be selectively actuated in groups as part of the blasting arrangement.

Therefore, the methods of the present invention, in which groups of wireless initiation devices may be selectively controlled and initiated, may be usefully applied to ring blasting techniques for underground mining. Multiple ring-blasts below the ground may now be controlled from above the ground via through-rock wireless signaling.

EXAMPLE 5

Selective Initiation of Wireless Initiation Devices for a Stratablast

This example illustrates how the methods of the present invention offer significant advantages to those wishing to conduct a Stratablast. The Stratablast technique is disclosed for example in international patent publication WO2005/052499 published Jun. 9, 2005, the contents of which are incorporated herein by reference. A Stratablast is a blasting technique for accessing and fragmenting a desired recoverable mineral seam that exists beneath an overburden of exposed rock having at least one free face of rock at the level of the mineral seam. For example, a Stratablast is illustrated schematically in FIG. 3, where the layer of overburden is shown as layer 30, and the desired mineral seam is shown as layer 31. Surface 32 represents the surface of the ground, or other surface perhaps located underground. Boreholes 33 are drilled into the overburden 30, with at least some of the boreholes 33*a* extending further down into the mineral seam 31. The boreholes are at least partially filled with explosive material, and each borehole is subsequently associated with an initiation device comprising a detonator. Traditionally, each detonator is connected via bus wires back to a control unit such as a blasting machine.

In accordance with the teachings of WO2005/052499 all detonators are actuated in a single blast cycle, with those detonators in boreholes 33*a* (i.e. those boreholes extending down into the mineral seam) being delayed by at least 500 ms relative to those detonators in the other boreholes (i.e. those boreholes not extending down into the mineral seam). In this way, explosive materials in boreholes 33 will initiate first to fragment and throw the overburden generally in the direction 35 of the free face 34, and away from the mineral seam 31. Very soon after the overburden has been 'thrown' the detonators in the remaining boreholes 33*a* initiate, thereby to fragment the now exposed mineral seam 31. In this way, the overburden is thrown aside to expose the mineral seam, and the mineral seam is subsequently fragmented, all in a single blast cycle without need to revisit the blast site and re-establish charges.

To date, Stratablast techniques have utilized detonators connected to a blasting machine via physical connections such as electrical wires. An initiation signal is sent to all detonators simultaneously via the physical wires. Subsequently the detonators count down their individual delay times to initiation, each using an internal power source (e.g. a capacitor). Inevitably, a 'traditional' Stratablast requires complex set-up of wires and physical connections at the blast site.

In contrast, the methods of the present invention enable wireless initiation devices (e.g. wireless electronic boosters) to be used effectively for Stratablast techniques. By virtue of the teachings herein, it is possible to load each borehole with a wireless initiation device. Subsequently, those wireless initiation devices located in boreholes 33*a* (i.e. those boreholes extending into the mineral seam) can be programmed and controlled as a separate group from the wireless initiation devices located in boreholes 33 (i.e. those boreholes not extending into the mineral seam). In other words, the methods of present invention facilitate the application of wireless initiation devices to Stratablast techniques, wherein the wireless initiation devices may be selectively controlled at the blast site according to the layer of rock in which they reside.

As a further advantage, the methods of the present invention permit the overburden to be 'thrown' and the mineral seam to be fragmented in two temporally distinct events that are not necessarily within a single blast cycle. In accordance with the selective blasting of the present invention, the overburden may be first 'thrown' by actuation of the group of wireless initiation devices in the boreholes 33. The efficiency of fragmentation and throw of the overburden from the mineral seam may then be assessed (for example using remote cameras etc.) before selective initiation of the second group of wireless initiation devices in boreholes 33*a* to fragment the exposed mineral seam.

The methods of the present invention present still further advantages to Stratablast techniques. As discussed above, a 'traditional' Stratablast employs a wired arrangement of detonators wherein an initiation signal is sent to all detonators simultaneously via the physical wires. Subsequently, the detonators operate and count down their individual delay times, powered by internal capacitors. Typically, each internal capacitor may have charge to power each detonator for only a very limited period of time (for example 9 to 14 seconds). As a result, all detonators at the blast site must complete their countdown and initiate within this short timeframe. It follows that rock movement from initiation of the devices in boreholes 33 (to throw the overburden) may not have time to settle before the devices in boreholes 33*a* (to fragment the desired layer of ore) are initiated. In direct contrast, the present invention involves the use of wireless initiation devices, which each include a source of power sufficient to power each device for a significant period of time at the blast site (e.g. perhaps a few hours or more). Thus, the inherent features of wireless initiation devices, and in particular the internal sources of power for the devices, provide an extended period for device control and initiation. It follows that the initiation of each group of wireless initiation devices (in boreholes 33 and 33*a*) may be temporally spaced by several seconds, minutes or even hours as desired. In this way, the fragmented and thrown overburden can completely settle before the desired layer of ore is then fragmented. This in turn may help reduce contamination of the fragmented ore with fragmented overburden.

EXAMPLE 6

Half-Face Sinking with Selective Initiation of Wireless Initiation Devices

The technique of half-face sinking is a shaft sinking method disclosed for example in Australian patent 768,956, derived from Australian application number AU 200059522 B2 published Apr. 26, 2001, which is incorporated herein by reference. The technique is here described briefly with reference to FIG. 4.

Figure 4A:
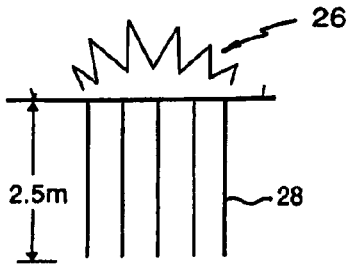
Figure 4B:
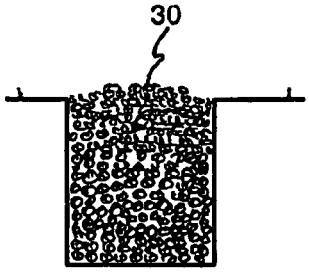
Figure 4D:
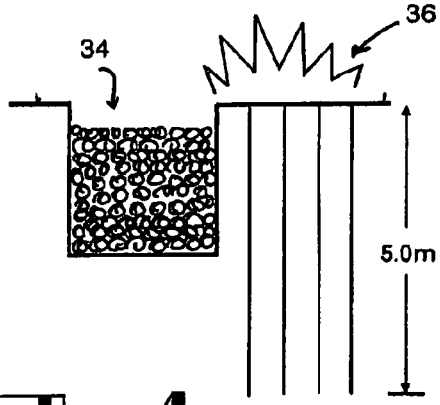
Figure 4C:
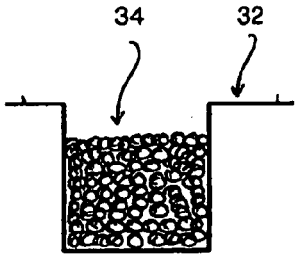
Figure 4E:
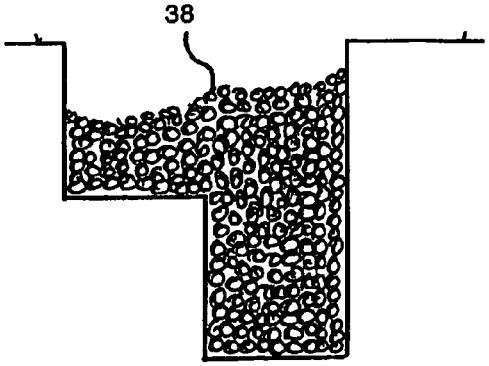
Figure 4F:
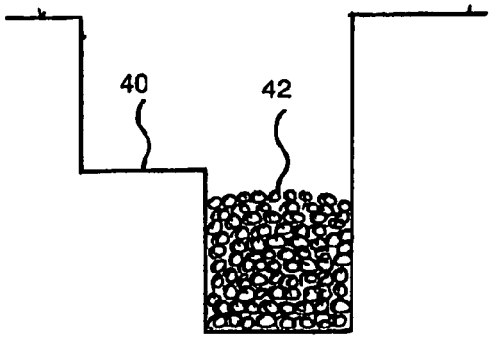
Figure 4G:
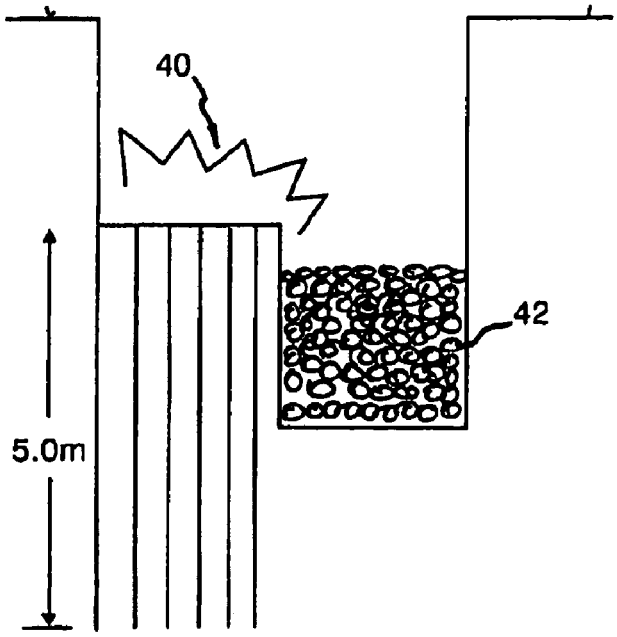
Figure 4H:
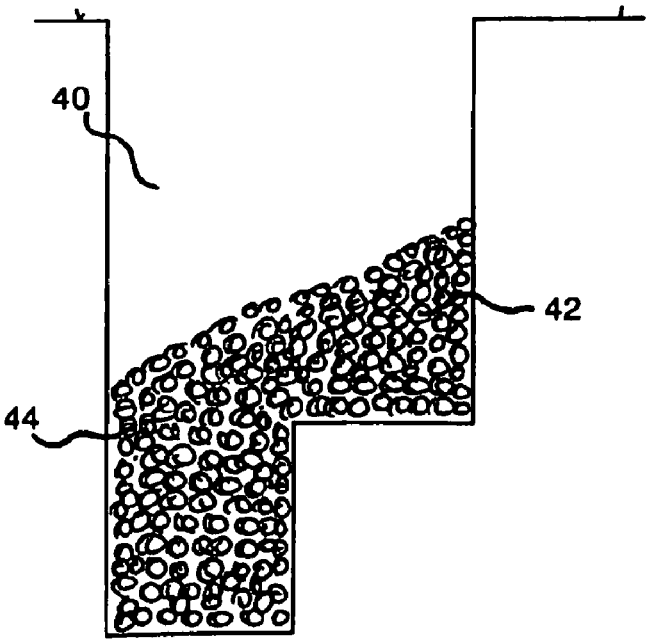

When blasting rock it is advantageous that a void in the rock or a free-face of rock be present to allow the fragmenting rock to move into the space of the void, or the space adjacent the free-face. In this way, the rock fragments efficiently and is readily positioned for removal from the blast site without difficulty. However, when sinking a new shaft into rock there is no void or free-face for rock fragmentation, movement and removal, and this can present a significant problem. The half-face sinking method alleviates this problem by effectively sinking the shaft in two halves, and attempts to achieve a free-face on at least one side of the shaft as it is sunk in stages. Initially boreholes are drilled into the surface of the rock over an area 26 over a first half of the shaft, and an initial blast is conducted (FIG. 4*a*). Some of the loose rock 40 is then removed by conventional mucking techniques, thereby creating a bench 42 and a sump 44, as can be seen in FIGS. 4*b* and 4*c*. Next, boreholes are drilled into the second half 36 of the shaft, corresponding to the bench 32 as can be seen in FIG. 4*d*. Detonation causes loose rock 38 to be thrown toward sump 34 as can be best seen in FIG. 4*e*. The loose rock is mucked by conventional techniques to create a new bench 40 and a new sump 42 as can be seen in FIG. 4*f*. Further cycles may be conducted to sink the shaft Using traditional blasting techniques, each blasting event for each half of the shaft (e.g. as shown in FIG. 4*d*) may involve a single blast cycle to blast the next column of rock (illustrated as being 5 meters in depth in FIG. 4*d*). In contrast, the methods of the present invention permit blasting of groups of wireless initiation devices in stages. For example, the boreholes illustrated in FIG. 4*d* could instead be divided into two sections in a similar manner to Stratablast techniques, with a first section extending only as far down as the base of sump 34 (i.e. bench 40 in FIG. 40, and a second section extending all the way down to the 5 meter depth shown in FIG. 4*d*. Therefore, as per Example 5 the boreholes may all be loaded with explosive material associated with a wireless initiation device, with the devices in the first section being selectively controlled and initiated as a first stage of the blast (to fragment the rock immediately adjacent the sump 34, and to move the fragmented rock to the left and into the sump 34) followed by initiation of the wireless initiation devices in the second sections of boreholes extending the full 5 meter depth (to fragment the rock on the right side of the shaft, which can be mucked out to form a new sump).

In this way, the selective initiation of wireless initiation devices in groups presents significant advantages to the blasting technique of half-face sinking. Indeed, the application of the methods of the present invention to half-face sinking is expected to dramatically improve the efficiency of rock movement and fragmentation, thus resulting in a faster rate of shaft sinking than was previously attainable. As mentioned for other examples, the methods of the present invention avoid the need for wired connections to initiation devices used to fragment the rock, and instead permit the selective control of wireless electronic boosters in groups, thus reducing the risk of improper or failed actuation of initiation devices, with significant improvements in safely.

Whilst the methods of the present invention are herein defined according to specifically recited embodiments and examples, a skilled artisan will appreciate that further embodiments are implicit from the present disclosure. It is Applicant's intention to encompass all embodiments of the invention, whether explicitly or implicitly inferred from the present disclosure, within the scope of the appended claims.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

The invention claimed is:

1. A method of controlling a predetermined group of wireless initiation devices within a plurality of such devices at a blast site, which method comprises:

transmitting to the plurality of wireless initiation devices a wireless command signal relating to some operation intended to be executed by the predetermined group of wireless initiation devices;

for each wireless initiation device receiving the wireless command signal, determining whether the wireless initiation device forms part of the predetermined group; and for each wireless initiating device that determines that it forms part of the predetermined group, executing the operation on the basis of the command signal.

2. The method of claim 1, wherein the wireless command signal comprises a group identification component that enables differentiation of wireless initiation devices forming part of the predetermined group from wireless initiating devices not forming part of the predetermined group, and wherein each wireless initiation device comprises:

a receiver for receiving a wireless command signal;

a memory component in which is stored a group identification; and a control circuit for comparing the group identification component with the stored group identification, for determining on the basis of that comparison whether the wireless initiation device forms part of the predetermined group, and for executing the intended operation of the wireless initiation device if it is determined that it forms part of the predetermined group.

3. The method of claim 1, wherein wireless command signal comprises a command selected from a command signal to FIRE the wireless initiation device, a command to ARM the wireless initiation device, a command to DISARM the wireless initiation device, a command to ACTIVATE the wireless initiation device, a command to DEACTIVATE the wireless initiation device, a command to SHUT-DOWN the wireless initiation device, and a command to CALIBRATE an internal clock of the wireless initiation device.

4. The method of claim 2, wherein the plurality of wireless initiation devices are divided into predetermined groups, with wireless initiation devices within the same predetermined group having the same stored group identification, and with wireless initiation devices in different predetermined groups having different stored group identifications, the group identification component of said wireless command signal corresponding to a group identification.

5. The method of claim 2, wherein each wireless initiation device in the plurality of wireless initiation devices has a unique stored group identification, and wherein the group identification component of the wireless command signal comprises a plurality group identification components corresponding to group identifications for the predetermined group of wireless initiation devices.

6. The method of claim 2, wherein following placement of each wireless initiation device at the blast site, all components of the device are checked for operative integrity, and wherein the group identification for each wireless initiation device is programmed into the memory component in situ at the blast site during the check.

7. The method of claim 2, wherein each wireless initiation device has a pre-stored factory identification code, and wherein each group identification is a separate identity element for each wireless initiation device that is programmed into the memory component in situ at the blast site.

8. The method of claim 7, wherein programming of the group identification for each wireless initiation device comprises:

transmitting a wireless group identification programming signal comprising (i) a factory identification code component and (ii) a group identification component to each wireless initiation device;

for each wireless initiation device receiving the factory identification code component, comparing the received factory identification code to its pre-stored factory identification code; and for each wireless initiation device that determines that the factory identification code component corresponds to its pre-stored factory identification code, storing in the memory component the group identification component as a group identification.

9. The method of claim 2, wherein each wireless initiation device is placed at a desired position at the blast site and programmed with a group identification via short range wired or wireless communication using a portable programming device.

10. The method of claim 2, wherein the group identification of each wireless initiation device corresponds to a factory programmed identification code of each wireless initiation device.

11. The method of claim 1, further comprising the step of:

deactivating or shutting-down each wireless initiation device that determines that it does not fall within the predetermined group.

12. The method of claim 2, wherein the group identification for each wireless initiation device is from 4 to 8 bits in length.

13. The method of claim 1, wherein each wireless initiation device forms part of a wireless electronic booster comprising an explosive charge.

14. A method of controlling a predetermined group of wireless electronic boosters within a plurality of such boosters at a blast site, which method comprises:

transmitting to the plurality of wireless electronic boosters a wireless command signal relating to some operation intended to be executed by the predetermined group of wireless electronic boosters;

for each wireless electronic booster receiving the wireless command signal, determining whether the wireless electronic booster forms part of the predetermined group; and for each wireless electronic booster that determines that it forms part of the predetermined group, executing the operation on the basis of the command signal.

15. The method of claim 14, wherein the wireless command signal comprises a group identification component that enables differentiation of wireless electronic boosters forming part of the predetermined group from wireless electronic boosters not forming part of the predetermined group, and wherein each wireless electronic booster comprises:

a receiver for receiving a wireless command signal;

a memory component in which is stored a group identification; and a control circuit for comparing the group identification component with the stored group identification, for determining on the basis of that comparison whether the wireless electronic booster forms part of the predetermined group, and for executing the intended operation of the wireless electronic booster if it is determined that it forms part of the predetermined group.

16. The method of claim 14, wherein the wireless command signal comprises a command selected from a command signal to FIRE the wireless electronic booster, a command to ARM the wireless electronic booster, a command to DISARM the wireless electronic booster, a command to ACTIVATE the wireless electronic booster, a command to DEACTIVATE the wireless electronic booster, a command to SHUT-DOWN the wireless electronic booster, and a command to CALIBRATE an internal clock of the wireless electronic booster.

17. The method of claim 15, wherein the plurality of wireless electronic boosters are divided into predetermined groups, with wireless electronic boosters within the same predetermined group having with the same stored group identification, and with wireless electronic boosters in different groups having different stored group identifications, the group identification component of the wireless command signal corresponding to a group identification.

18. The method of claim 15, wherein each wireless electronic booster in the plurality of wireless electronic boosters has a unique stored group identification, and wherein the group identification component of the wireless command signal comprises a plurality of group identification components corresponding to group identifications for the predetermined group of wireless electronic boosters.

19. The method of claim 15, wherein following placement of each wireless electronic booster at the blast site, all components of the booster are checked for operative integrity, and wherein the group identification for each wireless electronic booster is programmed into the memory component in situ at the blast site during the check.

20. The method of claim 15, wherein each wireless electronic booster has a pre-stored factory identification code, and wherein each group identification is a separate identity element for each wireless electronic booster that is programmed into the memory unit in situ at the blast site.

21. The method of claim 20, wherein programming of the group identification for each wireless electronic device comprises:

transmitting a wireless group identification programming signal comprising (i) a factory identification code component and (ii) a group identification component to each wireless electronic booster;

for each wireless electronic booster receiving the factory identification code component, comparing the factory identification code to its pre-stored factory identification code; and for each wireless electronic booster that determines that the factory identification code component corresponds to its pre-stored factory identification code, storing in the memory component the group identification component as a group identification.

22. The method of claim 15, wherein each wireless electronic booster is placed at a desired position at the blast site and programmed with a group identification via short range wired or wireless communication using a portable programming device.

23. The method of claim 15, wherein the group identification of each wireless initiation device corresponds to a factory programmed identification code of each wireless electronic booster.

24. The method of claim 14, further comprising the step of:

deactivating or shutting-down each wireless electronic booster device that determines that it does not fall within the predetermined group.

25. The method of claim 15, wherein the group identification for each wireless electronic booster is from 4 to 8 bits in length.

26. The method of claim 1, wherein the group identification for each wireless initiation device is at least 4 bits in length.

27. The method of claim 14, wherein the group identification for each wireless initiation device is at least 4 bits in length.

* * * * *